US009176430B2

(12) United States Patent
Yoshizawa et al.

(10) Patent No.: US 9,176,430 B2
(45) Date of Patent: Nov. 3, 2015

(54) DEVELOPING DEVICE AND IMAGE FORMING APPARATUS INCORPORATING SAME

(71) Applicants: Hideo Yoshizawa, Kanagawa (JP); Noriyuki Kimura, Kanagawa (JP); Yoshihiro Fujiwara, Kanagawa (JP); Yuki Oshikawa, Kanagawa (JP); Sohichi Abe, Kanagawa (JP)

(72) Inventors: Hideo Yoshizawa, Kanagawa (JP); Noriyuki Kimura, Kanagawa (JP); Yoshihiro Fujiwara, Kanagawa (JP); Yuki Oshikawa, Kanagawa (JP); Sohichi Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/193,372

(22) Filed: Feb. 28, 2014

(65) Prior Publication Data

US 2014/0270838 A1 Sep. 18, 2014

(30) Foreign Application Priority Data

Mar. 13, 2013 (JP) ..... 2013-050432

(51) Int. Cl.
*G03G 21/00* (2006.01)
*G03G 15/08* (2006.01)
*G03G 15/09* (2006.01)

(52) U.S. Cl.
CPC ..... *G03G 15/0893* (2013.01); *G03G 15/09* (2013.01); *G03G 2215/0827* (2013.01); *G03G 2215/0838* (2013.01)

(58) Field of Classification Search
CPC ..... G03G 2215/0827; G03G 15/0893; G03G 15/09
USPC ..... 399/99
See application file for complete search history.

(56) References Cited

U.S. PATENT DOCUMENTS

| | | | |
|---|---|---|---|
| 2003/0231906 | A1 | 12/2003 | Yoshizawa |
| 2009/0041508 | A1 | 2/2009 | Oshikawa et al. |
| 2010/0215401 | A1 | 8/2010 | Fujiwara et al. |
| 2011/0150525 | A1 | 6/2011 | Fujiwara et al. |
| 2012/0207492 | A1 | 8/2012 | Fujiwara et al. |

FOREIGN PATENT DOCUMENTS

| | | |
|---|---|---|
| JP | 2006-145921 | 6/2006 |
| JP | 2007-140288 | 6/2007 |
| JP | 2009-020276 | 1/2009 |
| JP | 2009-223075 | 10/2009 |
| JP | 2010-008978 | 1/2010 |
| JP | 2010-054932 | 3/2010 |
| JP | 2010-217425 | 9/2010 |
| JP | 2010-237635 | 10/2010 |

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A developing device includes a developer bearer to carry developer, disposed facing an image bearer, a developer conveyance member disposed facing the developer bearer, to agitate and supply developer to the developer bearer, a decompression portion surrounded by upper walls of the developing device and including multiple vents arranged in a longitudinal direction of the developing device and a filter. A number of the multiple vents is greater in either end portion than in a center portion in the longitudinal direction of the developing device.

20 Claims, 10 Drawing Sheets

DEVELOPING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-050432, filed on Mar. 13, 2013, in the Japan Patent Office, the entire disclosure of which is hereby incorporated by reference herein.

BACKGROUND OF THE INVENTION

1. Technical Field

The present invention generally relates to a developing device to develop a latent image with developer and an image forming apparatus, such as copier, a printer, a facsimile machine, a plotter, or a multifunction peripheral (MFP) having at least two of coping, printing, facsimile transmission, plotting, and scanning capabilities, that includes the same.

2. Description of the Background Art

In image forming apparatuses employing a developing device, typically an exposure device forms a electrostatic latent image on an image bearer, such as a photoreceptor, according to image data, and the developing device develops the latent image into a toner image. The toner image is then transferred onto a recording medium either directly or via an intermediate transfer member (i.e., an intermediate transfer belt) and fixed thereon by a fixing device.

There are developing devices that use two-component developer consisting essentially of toner and magnetic carrier (inclusive of external additives) and one-component developer consisting essentially of toner (inclusive of external additives).

For example, two-component type developing devices agitate developer inside the developing device to mix together toner and magnetic carrier, adjust the concentration of toner in two-component developer (hereinafter simply "developer") to a proper value, and then supply the developer to a developer bearer such as a developing roller. The amount of developer carried on the developing roller is adjusted by a developer regulator such as a doctor blade, after which the developer is transported to a development range where the developing roller faces the photoreceptor through an opening formed in a development casing. Then, developer (i.e., toner therein) adheres to the electrostatic latent image formed on the photoreceptor, thereby developing it. Most of toner particles inside the developing device is adsorbed onto the surfaces of carries through frictional charging with carriers and caused to adhere to the electrostatic latent image on the photoreceptor due to the effects of developing electrical fields generated between the developing roller and the photoreceptor in the development range.

Powdered toner, however, includes carrier particles whose charging capabilities are insufficient and toner particles insufficiently charged by friction with carrier particles. Further, the charging capabilities of carrier in the developing device may deteriorate over time. Such insufficiently charged toner escapes electric restraint and floats inside the device, entrained on airflow generated inside the device. When the average of pressure inside the entire developing device (hereinafter simply "internal pressure") is high, it is possible that floating toner spurts out the developing device through clearance and scatters.

Internal pressure rises inside the developing device, which invite toner scattering, are described below.

Internal pressure rises are caused by changes in airflow due to rotation of a transport roller or the developing roller. In particular, the developing roller is exposed to the external air, and an exit side (at an upstream rim of the opening of the development casing) in the direction of rotation thereof is closed by the doctor blade and developer. On an entry side (at a downstream rim of the opening) in the direction of rotation of the developing roller, clearance called a casing gap (CG) is present between the developing roller and the downstream rim of the opening, and sucking-in airflow is generated as the developing roller rotates, thereby increasing the internal pressure. The casing gap (CG) is an important factor in development.

Although the internal pressure is raised by sucking-in airflow caused by rotation of the developing roller, air suction is not uniform in the longitudinal direction of the developing roller. Although it depends on differences in the casing gap CG, the deference between the end portions and the center portion is caused by side plates of the development casing. Since the end portions are closer to the respective side plates, the internal pressure rises therein. Specifically, pressure does not rise in the center portion since the sucked in air flows to the left and right. In the end portions, however, the airflow is blocked by the side plates, and accordingly pressure is likely to rise.

Additionally, a magnet provided inside the developing roller is shorter than the developing roller, and the end portions of the developing roller are outside the magnetic force range. Accordingly, developer is not transported in the end portions, and airflow arising inside the magnetic force range surges to the end portions where airflow is not generated. Further, beneath the developing roller, a developer conveyance member such as a conveying screw circulates developer laterally and influences the airflow. It is deemed that, due to this influence, development quality in the both end portions is not identical, and the scattering of toner from one side is greater.

JP-2009-223075-A (JP-5106191-B) and JP-2010-237635-A mentions that, as the developing roller rotates, air flows in through the casing gap, and pressure inside the device rises, fostering toner scattering therefrom. JP-2009-223075-A proposes a configuration in which a suction port is formed in an inner wall of the development casing and extends long in the longitudinal direction of the development casing, a filter is provided to the suction port, and an exhaust space is provided in the longitudinal direction of the development casing covered with a filter cover. In this configuration, airflow inside the development casing is guided to vents (i.e., openings) formed in longitudinal end portions of the developing device and discharged outside the image forming apparatus to suppress internal pressure rises.

By contrast, JP-2010-237635-A proposes forming a suction port in an inclined wall of the development casing on a side opposite the image bearer to guide the airflow to the outside of the image forming apparatus. The suction port is constructed of multiple through holes identical in shape and arranged symmetrically in the lateral direction, at regular intervals in the longitudinal direction of the development casing. Then, air is discharged outside the apparatus via a filter from the development casing through the multiple through holes dispersed in the longitudinal direction to suppress internal pressure rises.

Additionally, JP-2010-008978-A proposes a configuration to discharge airflow inside a developer chamber upward from an upward opening positioned in an upper part of the development casing. JP-2010-054932-A proposes a configuration in which airflow at a communicating opening in an upper part of the development casing is discharged upward from an upward slit.

Further, JP-2007-140288-A and JP-2009-020276-A propose discharging airflow from the developer casing upward through a pressure-release opening positioned in an upper part of the development casing. Yet further, JP-2010-217425-A proposes discharging airflow from the developer casing obliquely upward through a pressure-release opening positioned in an inclined wall of an upper part of the development casing.

It is to be noted that JP-2006-145921 (JP-4535852-B) mentions a configuration in which, airflow at the casing gap goes inside the development casing in a center portion in the width direction of the casing gap and goes outside at both ends in that direction. In this configuration, an end portion in the width direction of an upper rim (a face opposed to the developing roller) at the casing gap is made longer in length in the direction of rotation of the developer bearer than in a center portion in the width direction to inhibit airflow from going outside, thereby inhibiting toner scattering.

SUMMARY OF THE INVENTION

In view of the foregoing, one embodiment of the present invention provides a developing device to develop with developer a latent image formed on an image bearer. The developing device includes a developer bearer to carry developer, disposed facing the image bearer, a developer conveyance member disposed facing the developer bearer, and a decompression portion surrounded by upper walls of the developing device. The developer conveyance member agitates developer contained in the developing device and supplies developer to the developer bearer. The decompression portion includes multiple vents arranged in a longitudinal direction of the developing device, and a filter is provided inside the decompression portion. A number of the multiple vents is greater in either end portion than in a center portion in the longitudinal direction of the developing device.

Another embodiment provides a developing device including the above-described developer bearer, the developer conveyance member, the decompression portion, and the filter. The decompression portion includes multiple vents arranged in a longitudinal direction of the developing device. An opening area of the multiple vents is greater in either end portion than in a center portion in the longitudinal direction of the developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
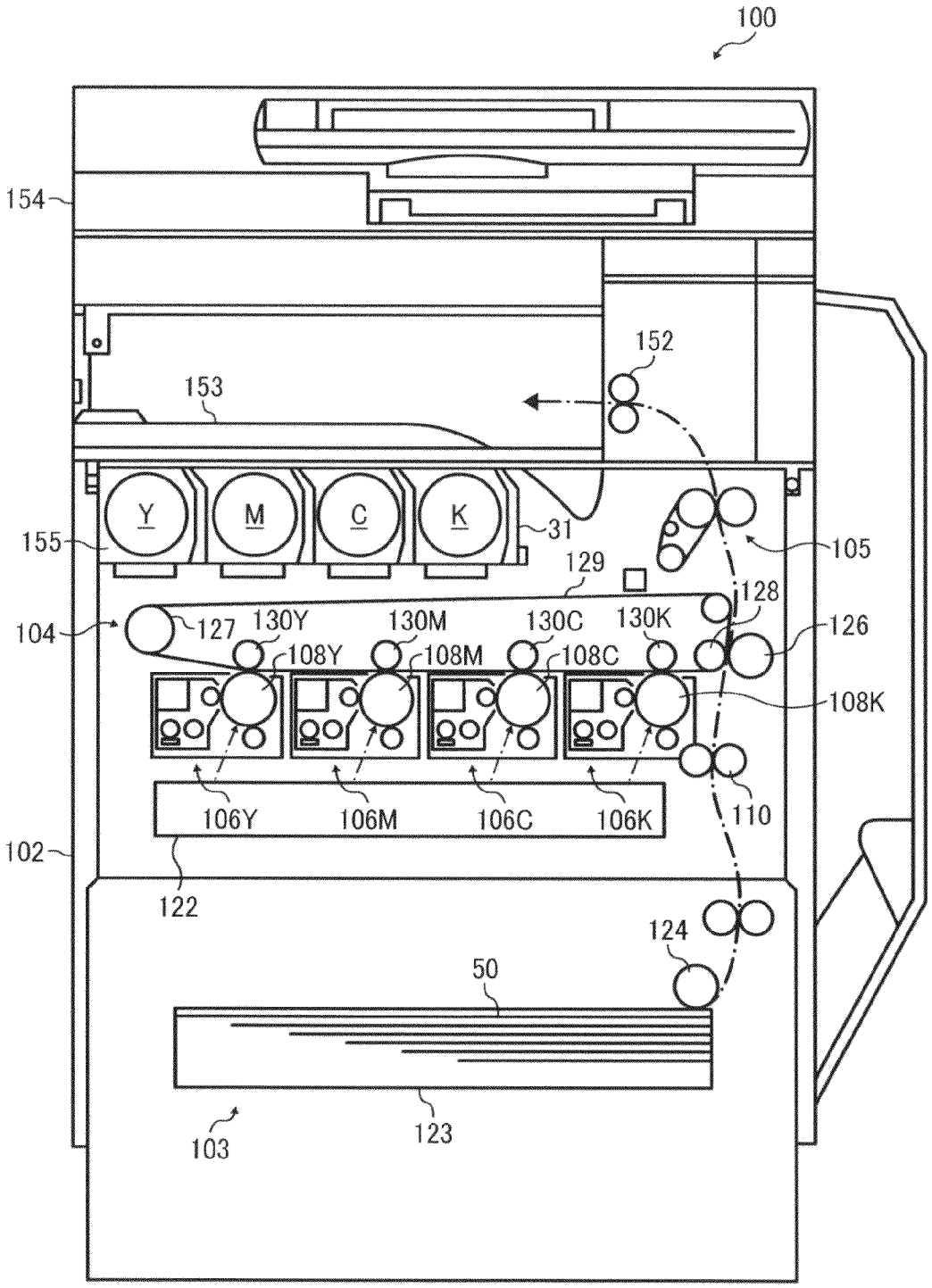
FIG. 1 is a schematic front view of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

If internal pressure in an entire developing device is high, there is a risk that airflow blows out through clearance of a development casing, thus causing toner to scatter. Although such internal pressure rises may be inhibited by providing an air-release fan to the development casing, it is difficult to secure a space to avoid interference with, for example, driving units for other components.

Therefore, a decompression space extending in the longitudinal direction of the developing device may be provided to the development casing so that airflow is guided therein and then discharged therefrom through a vent or multiple vents extending long in the longitudinal direction without internal pressure unevenness. At that time, typically multiple vents are formed at substantially regular intervals in the longitudinal direction of the development casing and thus dispersed to secure the rigidity of the development casing. Additionally, the opening area is made substantially identical in the longitudinal direction of the development casing to discharge the airflow uniformly.

The airflow in the decompression space, however, is deflected to the longitudinal end side, affected by the side plates of the development casing, the arrangement of magnetic force exerted by the developing roller, and flow of developer in a developer containing portion in the developer casing.

Accordingly, in configurations in which the opening area is uniform in the longitudinal direction of the development casing, it is possible that the internal pressure at the end portions rises higher than that in the center portion in the longitudinal direction. When the internal pressure in the end portions of the decompression space rises, toner may scatter out through clearance at the end portions of the development casing where sealing capability is lower.

Additionally, in multicolor image forming apparatuses in which multiple developing devices are disposed beneath an intermediate transfer belt and arranged in line, when airflow is discharged upward from a vent formed in an upper wall or inclined upper wall of the developing device, there is a risk that a toner image transferred by an upstream developing device is blown away by upward airflow exhausted from the development casing of a downstream developing device, causing toner scattering. As a result, image density decreases.

In view of the foregoing, an aim of embodiments described below is to provide a developing device in which pressure rises at the longitudinal end portions of a decompression portion inside the developing device are suppressed, thereby inhibiting toner scattering, and to provide a process cartridge and an image forming apparatus incorporating the developing device.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic front view of an image forming apparatus 100.

The image forming apparatus 100 forms yellow (Y), magenta (M), cyan (C), and black (K) images on sheets of recording media. The image forming apparatus 100 is a tandem image forming apparatus that uses an intermediate transfer belt 129.

It is to be noted that that the suffixes Y, M, C, and K attached to the end of each reference numeral indicate only that components indicated thereby are used for forming yellow, magenta, cyan, and black images, respectively, and hereinafter may be omitted when color discrimination is not necessary.

Referring to FIG. 1, the image forming apparatus 100 includes an apparatus body 102, a sheet feeder 103, a pair of registration rollers 110, an intermediate transfer unit 104, and a secondary-transfer roller 126.

The image forming apparatus 100 further includes a fixing device 105, and a laser writing unit 122. The laser writing unit 122 forms electrostatic latent images on photoreceptor drums 108 according to image data.

Figure 4:
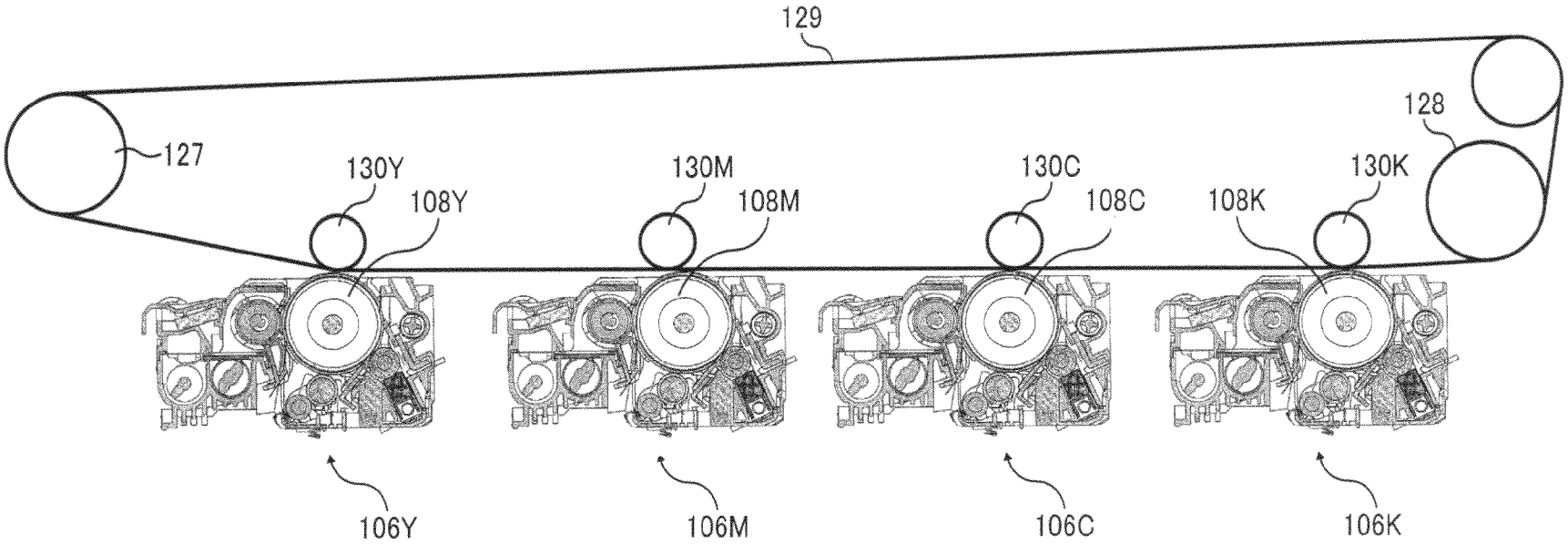
FIG. 4 is a diagram illustrating an arrangement of respective color process cartridges in the image forming apparatus shown in FIG. 1.

As shown in FIGS. 1 and 4, process cartridges 106Y, 106M, 106C, and 106K, serving as image forming units, are arranged in line beneath the intermediate transfer belt 129. The process cartridges 106 are removably insertable into the apparatus body 102.

The sheet feeder 103 includes a sheet tray 123 for containing multiple sheets 50 of recording media and a feed roller 124. The sheet tray 123 can be pulled out from and retracted into the apparatus body 102.

The feed roller 124 is pressed against the sheet 50 on the top in the sheet tray 123. The feed roller 124 and a sheet separator together separate the top sheet 50 from the rest and feed it to the registration rollers 110.

The pair of registration rollers 110 is positioned in a conveyance path through which the sheet 50 is fed from the sheet feeder 103 to a secondary transfer position. The registration rollers 110 stop the sheet 50 by clamping it in the nip therebetween, and then forward the sheet 50 timed to coincide with arrival of an image formed on the intermediate transfer belt 129.

The intermediate transfer unit 104 is provided above the process cartridges 106Y, 106M, 106C, and 106K. The intermediate transfer unit 104 includes a driving roller 128, a driven roller 127, the intermediate transfer belt 129, and primary-transfer rollers 130Y, 130M, 130C, and 130K.

The driving roller 128 is positioned facing the secondary-transfer roller 126 via the intermediate transfer belt 129 and driven by a driving source such as a motor. The driven roller 127 is rotatably supported by the apparatus body 102.

The intermediate transfer belt 129 is an endless belt and stretched around the driving roller 128 and the driven roller 127. As the driving roller 128 rotates, the intermediate transfer belt 129 rotates counterclockwise in FIG. 1.

Each primary-transfer roller 130 is positioned facing, via the intermediate transfer belt 129, the photoreceptor drum 108 included in the corresponding process cartridge 106.

Yellow, magenta, cyan, and black toner images formed by the respective process cartridges 106 are transferred primarily by the respective intermediate transfer rollers 130 and superimposed one on another on the intermediate transfer belt 129, thus forming a multicolor toner image.

The intermediate transfer belt 129 transports the multicolor toner image to the secondary-transfer position, where the secondary-transfer roller 126 secondarily transfers the multicolor toner image onto the sheet 50.

The sheet 50 carrying the multicolor toner image is sent to the fixing device 105. The fixing device 105 fixes the toner image on the recording sheet 50 with heat and pressure (fixing process). It is to be noted that, although a belt-fixing type fixing device is used in the configuration shown in FIG. 1, alternatively, the fixing device 105 may be a heat roller type fixing device in which a fixing roller and a pressure roller press against each other, forming a fixing nip.

After the fixing process, the sheet 50 is discharged by a pair of discharge rollers 152 to a discharge tray 153. In FIG. 1, reference numeral 154 denotes an image reading unit.

The laser writing unit 122 is attached to the bottom of the process cartridges 106. The laser writing unit 122 corresponds to the respective process cartridges 106.

After a charging roller 109 (shown in FIG. 3) charges the surface of the photoreceptor drum 108 uniformly, the laser writing unit 122 directs a laser beam according to image data onto the surface of the photoreceptor drum 108 at an exposure position P (shown in FIG. 3), thus forming an electrostatic latent image thereon.

The process cartridges 106 are positioned between the intermediate transfer unit 104 and the laser writing unit 122. The process cartridges 106 are arranged in parallel to each other in the direction in which the intermediate transfer belt 129 transports the sheet 50.

Figure 3:
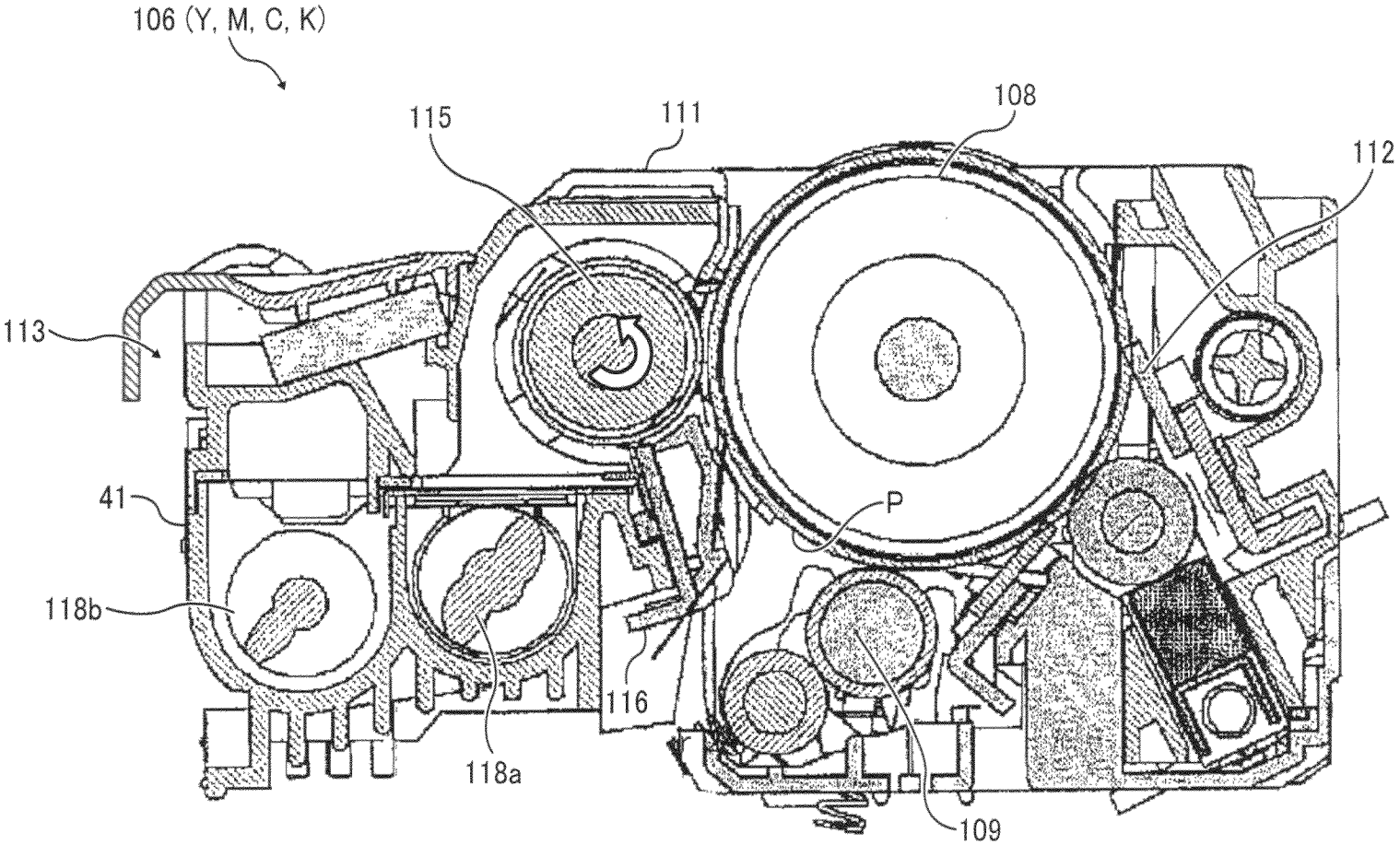
FIG. 3 is an end-on axial view of a process cartridge including the developing device shown in FIG. 2.

Each process cartridge 106 includes a cartridge casing 111 capable of accommodating the photoreceptor drum 108 and a developing device 113. As shown in FIG. 3, around the photoreceptor drum 108, the charging roller 109 serving as a charger, the exposure position P, the developing device 113, and a cleaning blade 112 serving as a cleaning device are provided facing the outer circumferential surface of the photoreceptor drum 108.

The charging roller 109 charges the surface of the photoreceptor drum 108 uniformly.

The photoreceptor drum 108 is positioned across a gap (i.e., development gap) from a developing roller 115 of the developing device 113.

The cleaning blade 112 removes toner remaining on the surface of the photoreceptor drum 108 after the toner image is transferred therefrom onto the intermediate transfer belt 129.

Figure 2:
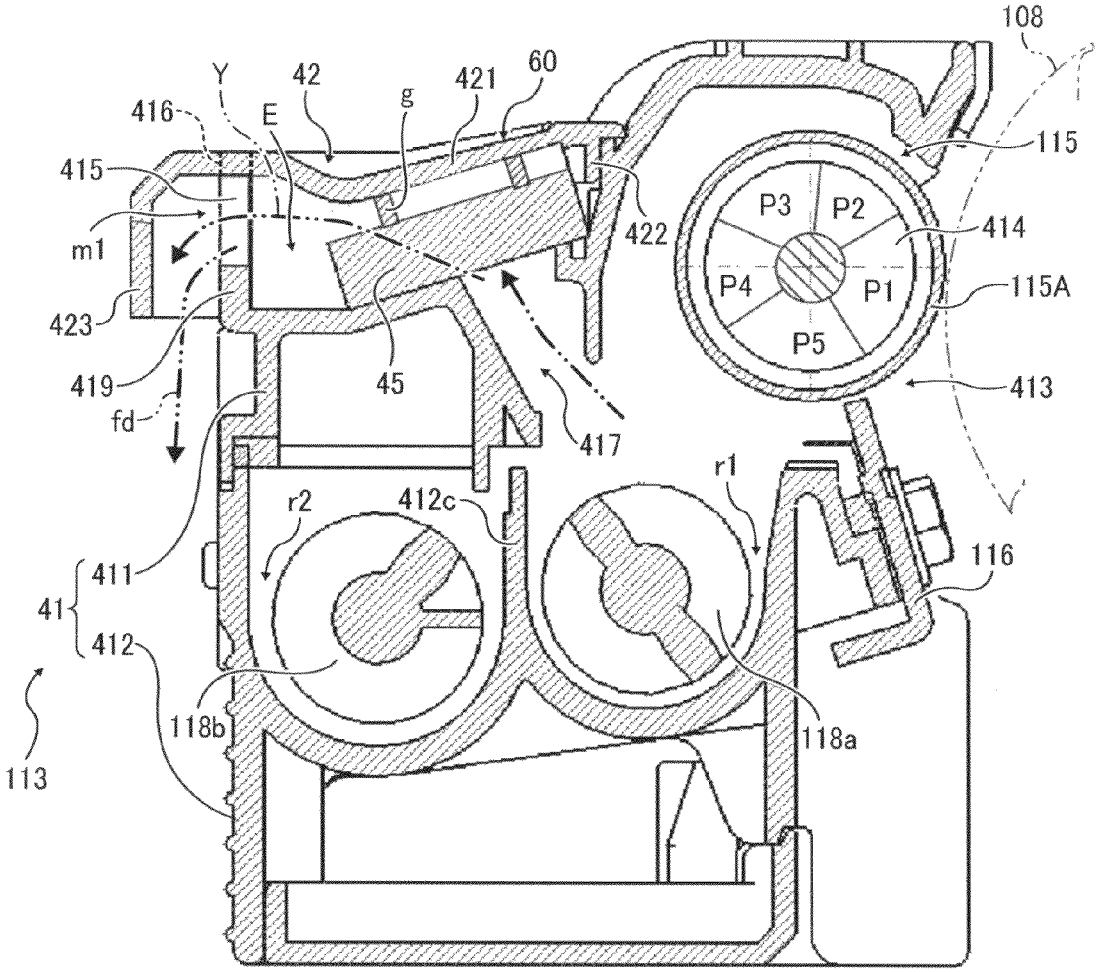
FIG. 2 is an end-on axial view of the developing device incorporated in the image forming apparatus shown in FIG. 1.

As shown in FIGS. 2 and 3, the developing device 113 includes a development casing 41 serving a as a case thereof. The development casing 41 includes a lower case 412 to hold the developing roller 115 and first and second agitation screws 118*a* and 118*b* and an upper case 411 attached to an upper part of the lower case 412. The upper case 411 and the lower case 412 are bonded together at proper positions, thus together forming the development casing 41.

Figure 5:
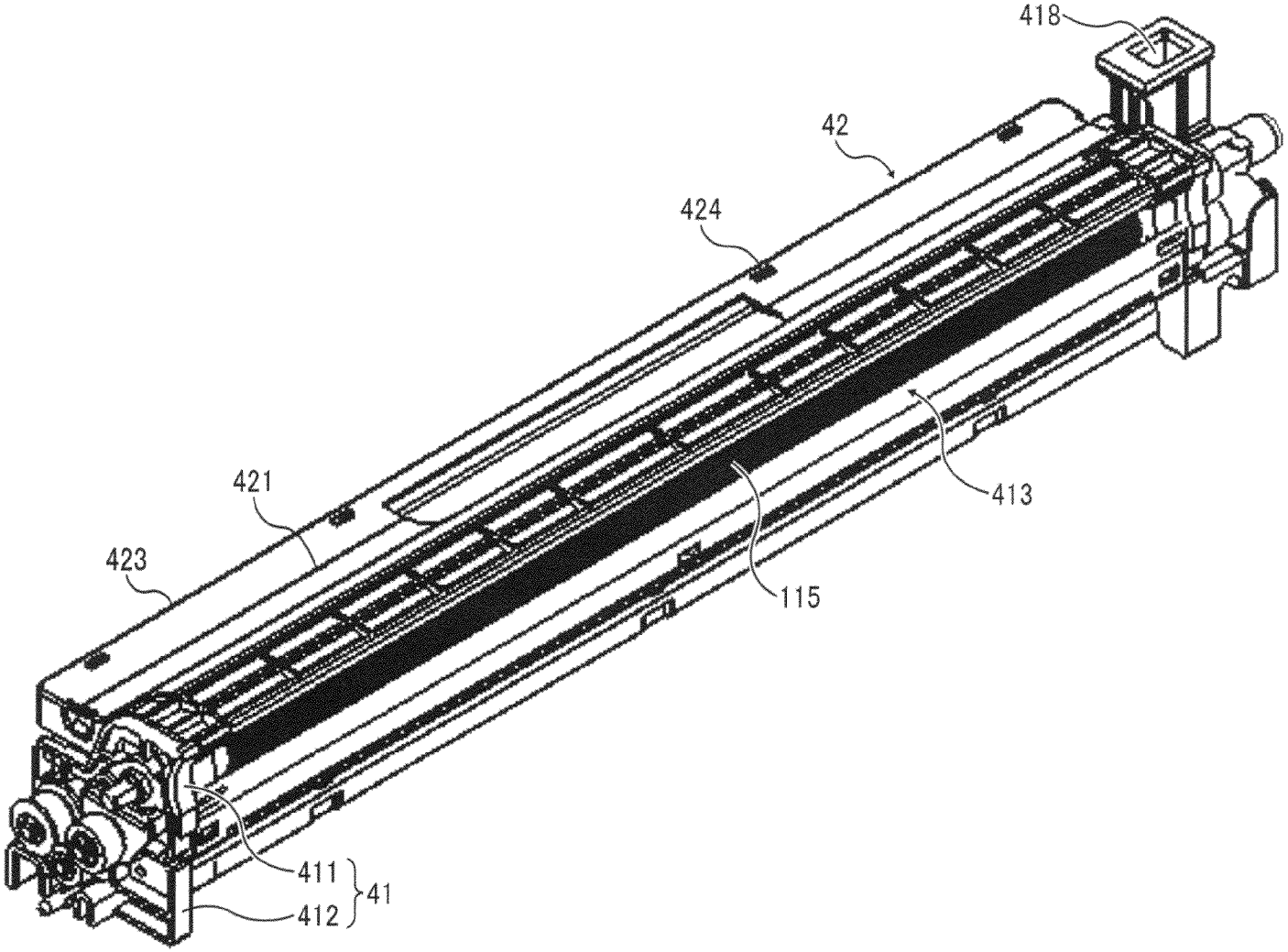
FIG. 5 is a perspective view of the developing device shown in FIG. 2, as viewed from an open side.

An opening 413 (shown in FIGS. 2 and 5) having a predetermined length extending in the longitudinal direction of the developing device 113 is formed between the upper and lower cases 411 and 412 and on the side of the photoreceptor drum 108. A part of the developing roller 115 projects outside the opening 413. The developing roller 115 serves as a developer bearer and includes a magnet roller 414.

As shown in FIG. 2, the lower case 412 contains the first and second agitation screws 118*a* and 118*b* disposed beneath the developing roller 115. The first and second agitation screws 118*a* and 118*b* serve as developer conveyance members to supply developer to the developing roller 115. The lower case 412 further contains a doctor blade 116 serving as a developer regulator.

The lower case 412 forms a developer container containing two-component developer. In the developer container, first and second developer compartments r1 and r2 provided with the first and second agitation screws 118*a* and 118*b* are partitioned from each other and arranged parallel to each other. Two-component developer can be agitated in the developer container and transported therefrom.

Operation of the image forming apparatus 100 shown in FIG. 1 is described below.

The photoreceptor drum 108 is rotated clockwise in FIG. 3 by a driving unit. The charging roller 109 uniformly charges the surface of the photoreceptor drum 108 in conjunction with the rotation thereof. At the exposure portion P, the surface of the photoreceptor drum 108 is scanned with the laser beam emitted from the laser writing unit 122, thus forming an electrostatic latent image.

Subsequently, the photoreceptor drum 108 reaches a position facing the developing device 113, where the latent image is developed with toner into a toner image.

Specifically, the ratio of toner to carrier (concentration of toner) in two-component developer contained in the developing device 113 is adjusted within a predetermined range. More specifically, according to the consumption of toner in the developing device 113, toner is supplied from a toner conveying pipe via a toner supply inlet 418 (shown in FIG. 5) to the second developer compartment r2.

The toner conveying pipe communicates with a corresponding one of toner bottles 155Y, 155M, 155C, and 155K mounted in a bottle mount 31 disposed in an upper portions of the apparatus body 102. Thus, a toner conveyance portion is constructed. Respective color toners are transported by the toner conveyance portions from the toner bottles 155 through the toner conveying pipes to the developing devices 113.

Subsequently, toner thus supplied is circulated between the first and second developer compartments r1 and r2 separated by a partition 412*c* while agitated with developer by the first and second agitation screws 118*a* and 118*b* (refer to FIGS. 2 and 10).

While thus agitated, toner particles in developer are charged by friction with carrier particles and adsorbed to the carrier particles. Then, the toner particles are carried on the developing roller 115 together with the carrier particles by multiple magnetic poles generated on the developing roller 115.

Referring to FIG. 2, the developing roller 115 includes the magnet roller 414 and a sleeve 115A that rotates around the magnet roller 414. As the sleeve 115A rotates around the magnet roller 414 in which the multiple magnetic poles are formed, developer moves in the circumferential direction (in the direction of arc) of the developing roller 115.

As the sleeve 115A rotates in the direction indicated by arrow shown in FIG. 3, developer carried on the developing roller 115 is transported to the doctor blade 116, where the amount of developer is adjusted, and then the developer is transported to the development range facing the photoreceptor drum 108. The electrical field formed with development bias (direct-current component in the present embodiment) causes toner to adhere to the latent image formed on the photoreceptor drum 108.

It is to be noted that, in the present embodiment, for example, the developing roller has an external diameter of 18 mm and a longitudinal length of 326 mm. Additionally, V-shaped grooves or recesses may be formed in the surface of the sleeve 115A at regular intervals in the circumferential direction (the shape of arc). Alternatively, the surface of the sleeve 115A may be blasted to have surface unevenness.

Additionally, in the present embodiment, for example, the development gap between the developing roller 115 and the photoreceptor drum 108 has a size of 0.3 mm±0.05 mm, and a doctor gap, which is a distance between the developing roller 115 and the doctor blade 116, is 0.5 mm±0.04 mm. The doctor blade 116 in the present embodiment is a planar member constructed of stainless steel, for example.

Further, each of the first and second agitation screws 118*a* and 118*b* is formed of a screw shaft having a diameter of about 5 mm and a bladed screw spiral having an external diameter of about 14 mm and winding around the screw shaft with a screw pitch of about 20 mm.

The magnet roller 414 generates the multiple magnetic poles around the developing roller 115. The multiple magnetic poles includes a main pole P1 positioned facing the photoreceptor drum 108, a scooping pole P5 (also "doctor-opposed pole") extending from a position facing the agitation screw 118*a* to a position facing the doctor blade 116, a developer release pole P4 positioned above the first developer compartment r1, and conveyance poles P2 and P3 positioned between the main pole P1 and the developer release pole P4.

Initially, the scooping pole P5 acts on magnetic carrier particles in developer, and thus developer contained in the first developer compartment r1 is partly carried on the developing roller 115. Then, the doctor blade 116 scrapes off developer partly from the developing roller 115 to adjust the amount of the developer carried thereon, and the scraped developer is returned to the first developer compartment r1. The developer particles that have passed through the doctor gap stand on end on the developing roller 115 due to the magnetic force exerted by the main pole P1, forming a magnetic brush in the development range and slidingly contact the photoreceptor drum 108. Thus, the toner in developer carried on the developing roller 115 adheres to the latent image formed on the photoreceptor drum 108. The developer that has passed through the development range is kept on the developing roller 115 by the magnetic force exerted by the conveyance pole P2 and is transported to the position corresponding to the developer release pole P4. Then, at a position corresponding to the developer release pole P4, magnetic repulsion acts on carrier particles, and thus the developer experienced the development process leaves the developing roller 115 and returns again to the first developer compartment r1.

Figure 10:
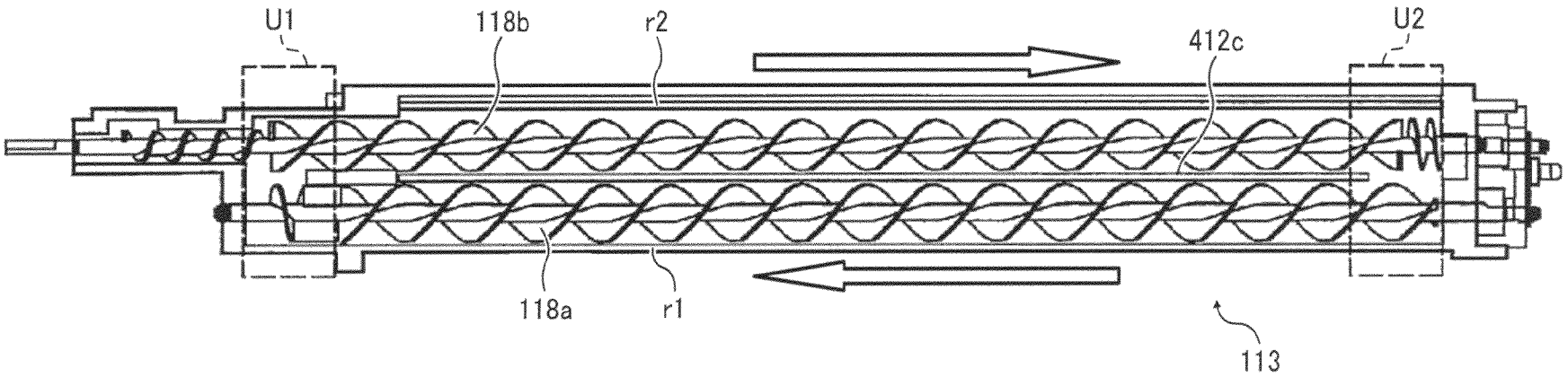
FIG. 10 is a schematic view of developer conveyance members in the developing device shown in FIG. 2.

As shown in FIG. 10, developer is transported downstream in the first developer compartment r1 and moves to the upstream side of the second developer compartment r2 through a first communication portion U1 in the direction indicated by arrows shown in FIG. 10, in which developer is circulated in the developing device 113 (hereinafter "developer conveyance direction"). On the upstream side in the second developer compartment r2, developer, together with toner supplied from the toner supply inlet 418 (shown in FIG. 5), is transported downstream in the second developer compartment r2 and moves to the upstream side of the first developer compartment r1 through a second communication portion U2. Such circulation of developer is repeated.

Since a small amount of toner remains untransferred on the photoreceptor drum 108 after the above-described development process, the untransferred toner is collected by the cleaning blade 112 at the position facing the cleaning blade 112.

In the developing device 113 incorporated in the image forming apparatus 100 shown in FIG. 1 that operates as described above, a decompression portion 60 (shown in FIG. 2) is provided to reduce the internal pressure of the developing device 113.

As shown in FIG. 2, the decompression portion 60 opens upward from an upper part of the upper case 411 and forms a long continuous recess extending in the longitudinal direction of the developing device 113, and the opening is closed by a sealing lid 42 serving as a cover. Thus, the decompression portion 60 forms a pressure-release compartment E continuously extending in the longitudinal direction of the developing device 113 (or the development casing 41).

Figure 6:
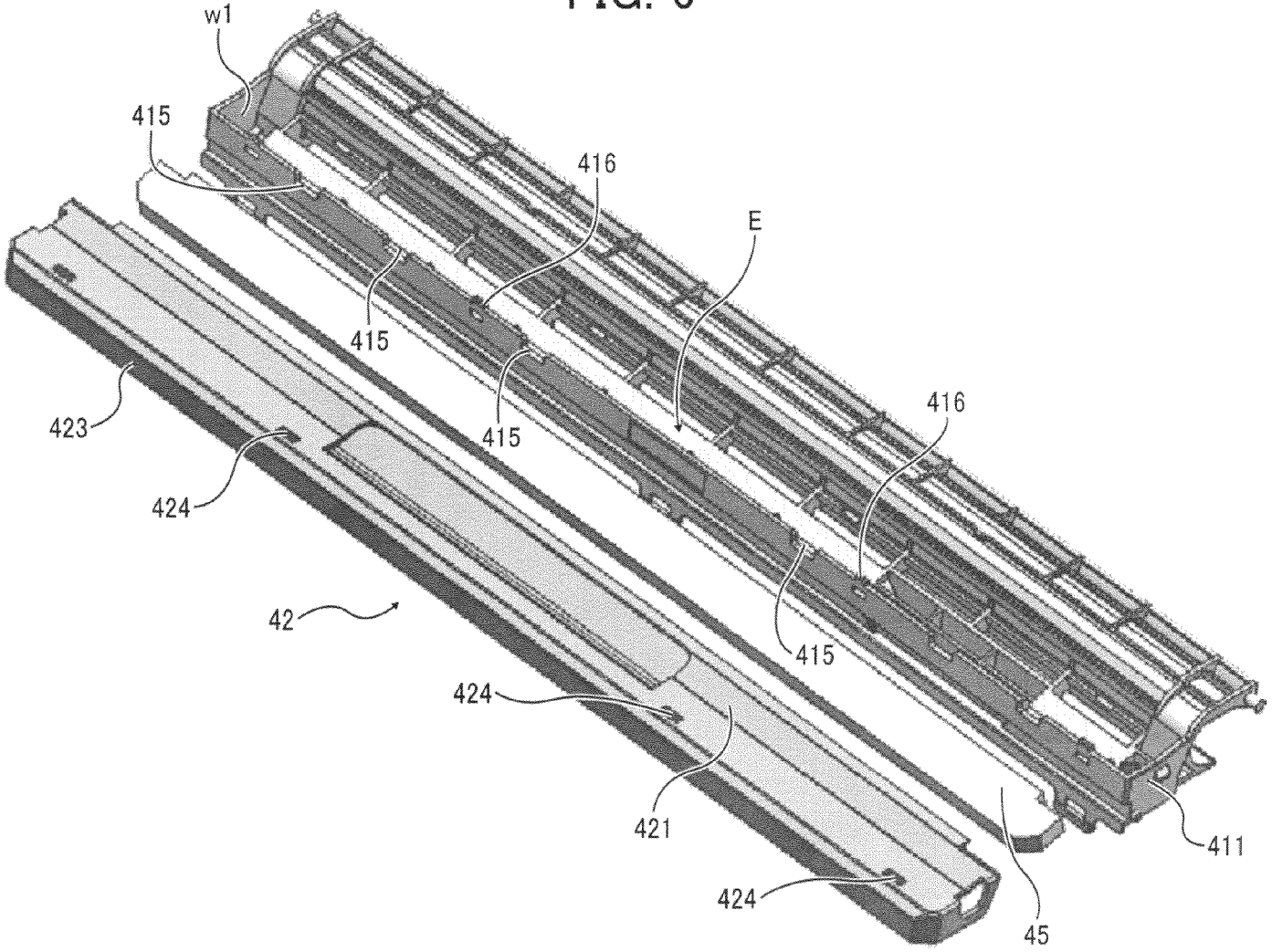
FIG. 6 is an exploded perspective view of an upper case and a sealing lid (i.e., cover)
Figure 7:
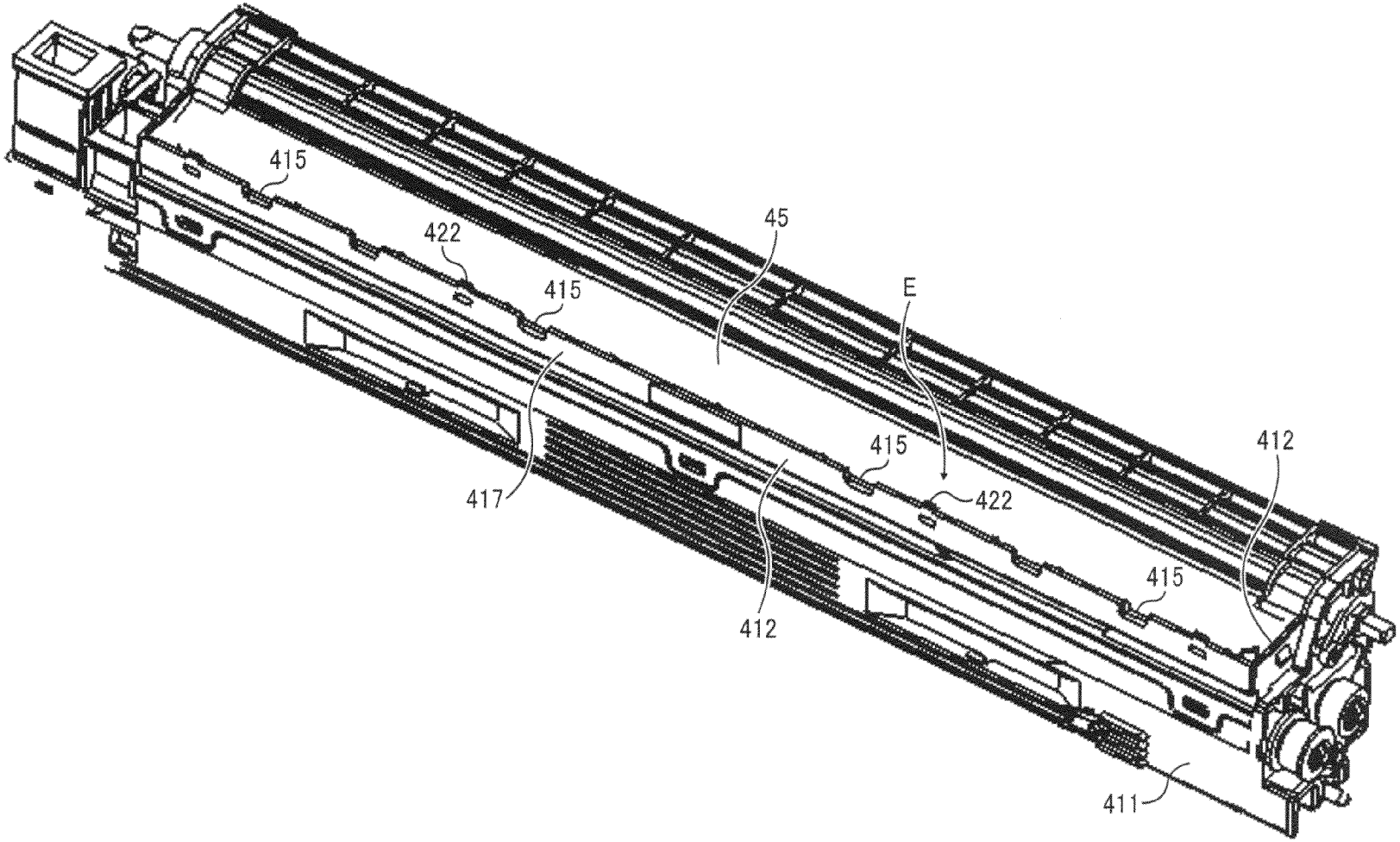
FIG. 7 is a perspective view illustrating a state in which the sealing lid is open in the developing device shown in FIG. 2.

As shown in FIGS. 6 and 7, the decompression portion 60 is provided with a filter 45 continuously extending in the longitudinal direction of the developing device 113, and the sealing lid 42 (shown in FIGS. 2 and 6) covers above the filter 45 across clearance. At that time, the filter 45 is pressed at multiple positions by projections g shown in FIG. 2, thereby inhibiting displacement.

As shown in FIG. 2, the upper case 411 defines a sucking-in inlet 417 that extends downward from the pressure-release compartment E of the decompression portion 60 toward a developer release position adjacent to the developer release pole P4 generated by the magnet roller 414. The sucking-in inlet 417 continuously extends in the longitudinal direction of the developing device 113 and guides air adjacent to the developer release position to the pressure-release compartment E. Airflow from the sucking-in inlet 417 passes through the filter 45 and flows into the pressure-release compartment E, being dispersed in the longitudinal direction of the pressure-release compartment E.

As shown in FIG. 2, a part of the upper case 411 on the side opposite the photoreceptor drum 108 serves as an exhaust-side wall 419 forming an outer wall of the decompression portion 60. The exhaust-side wall 419 extends in the longitudinal direction of the developing device 113. In the exhaust-side wall 419, multiple exhaust slots 415 are formed to discharge airflow from the pressure-release compartment E. It is to be noted that arrow Y in FIG. 2 represents the direction of airflow discharged from the decompression portion 60.

As shown in FIGS. 2 and 6, the sealing lid 42 that forms an upper part of the decompression portion 60 includes a main part 421 and an insertion hook 422. The main part 421 covers the pressure-release compartment E extending in the longitudinal direction, and the insertion hook 422 projects downward from an end of the main part 421. Further, the sealing lid 42 forms a guide 423 positioned outside the pressure-release compartment E and beyond the exhaust-side wall 419. The guide 423 extends downward from the other end of the main part 421, that is, from a position outward from an outer rim of the sealing lid 42.

As shown in FIG. 6, multiple retaining holes 424 are formed in the main part 421. Multiple latched pieces 416 are formed at the projecting end of the exhaust-side wall 419 (refer to FIG. 2) extending in the longitudinal direction of the developing device 113. As the latched pieces 416 engage the respective retaining holes 424, the guide 423 and the main part 421 of the sealing lid 42 are fixed.

It is to be noted that the insertion hook 422 at the end of the main part 421 (refer to FIG. 2) is pushed in an inner wall of the decompression portion 60 of the upper case 411. The insertion hook 422 deforms elastically and fits in a recess formed in the inner wall. Thus, the insertion hook 422 is attached thereto.

In the developing device 113 shown in FIGS. 1 and 2, the filter 45 is provided inside the decompression portion 60 sealed by the sealing lid 42. Thus, users can be free from contact with the filter 45 clogged with toner in replacement of the developing device 113 or the process cartridge 106.

Additionally, as shown in FIGS. 6 and 7, the multiple exhaust slots 415 are formed in the exhaust-side wall 419 that is the wall of the device on the side opposite the developing roller 115 and the photoreceptor drum 108. The multiple exhaust slots 415 are arranged in the longitudinal direction of the developing device 113. In particular, the number of the exhaust slots 415 is greater in the longitudinal end portions of the device than in the longitudinal center portion thereof.

With this configuration, when the sealing lid 42 is attached to the exhaust-side wall 419 of the upper case 411, the multiple exhaust slots 415 become multiple exhaust vents m1 (shown in FIG. 8) facing the guide 423. The exhaust vents m1 are open in the direction perpendicular to both of the longitudinal direction of the device and a vertical direction (direction of gravity). The number of the exhaust vents m1 is greater in longitudinal end portions bp (shown in FIGS. 8 and 9) of the device than in a longitudinal center portion ap (shown in FIGS. 8 and 9) thereof. Since the exhaust vents m1 face the guide 423, airflow is guided down. Thus, the airflow turns into a downward flow fd. Thus, the guide 423 functions as a downward duct.

Operation of the decompression portion 60 (i.e., the pressure-release compartment E) to reduce the internal pressure of the developing device 113 is described below.

When the internal pressure of the developing device 113 is about to rise due to the rotation of the agitation screws 118*a* and 118*b*, air inside the developing device 113 flows through the sucking-in inlet 417 into the decompression portion 60 and filtered by the filter 45. After toner floating therein is thus caught by the filter 45, the filtered air is discharged outside the developing device 113 from the exhaust vents m1. The exhaust vents m1 are open in the direction (i.e., a horizontal direction) perpendicular to both of the longitudinal direction of the device and the vertical direction, that is, the exhaust vents m1 are formed in a vertical face of the decompression portion 60. Accordingly, as indicated by arrow Y shown in FIG. 2, the filtered air is discharged horizontally from the exhaust vents m1 and then is guided down. Thus, internal pressure rise is inhibited, and scattering of toner from the developing device 113 can be reduced.

Figure 8:
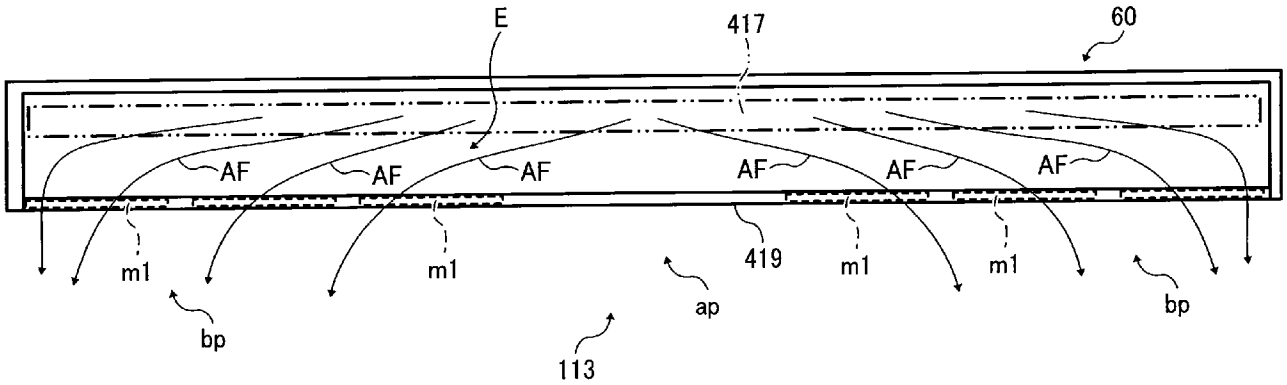
FIG. 8 is a schematic view of a pressure-release compartment of the developing device shown in FIG. 2 for understanding of airflow discharged therefrom.

FIG. 8 is a schematic view of the pressure-release compartment E for understanding of airflow discharged therefrom.

Figure 9:
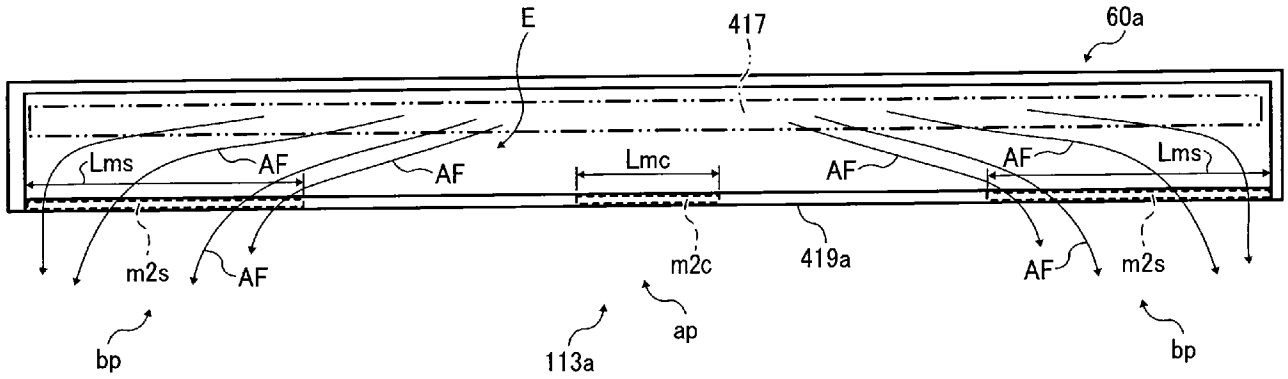
FIG. 9 is a schematic view of a pressure-release compartment of a developing device according to another embodiment for understanding of airflow discharged therefrom.

It is to be noted that reference characters "AF" in FIGS. 8 and 9 represent airflow in the developing device 113.

As shown in FIG. 8, air inside the developing device 113 passes through the sucking-in inlet 417 and filtered by the filter 45. Then, the air flows in the pressure-release compartment E (i.e., decompression portion 60) extending in the longitudinal direction of the developing device 113. At that time, air flowing into the decompression portion 60 (hereinafter "airflow AF") is affected by the fact that side plates w1 (shown in FIG. 6) at the axial ends of the upper case 411 are close, the arrangement of magnetic force exerted by the developing roller 115 (conveyance capability is higher in the center portion than in both end portions), and flow of developer in the first and second developer compartments r1 and r2 (indicated by arrows shown in FIG. 10). Affected by those, the airflow AF in the pressure-release compartment E is deflected toward the both ends.

Since the number of the exhaust vents m1 is greater in the longitudinal end portions by than in the longitudinal center portion ap as described above, a greater opening area is secured on both end sides. Accordingly, the airflow AF, which tends to surge to the end sides, can be easily discharged outside the device. Thus, the airflow exhaust capability can be enhanced. Therefore, pressure rise in the end portions can be inhibited, thus securing the effect of internal pressure reduction to prevent toner scattering. This configuration can inhibit occurrence at an early stage of clogging with toner of the filter 45 in the end portions in the longitudinal direction of the developing device 113, and increases in the frequency of maintenance can be prevented.

Further, air discharged from the exhaust vents m1 of the developing device 113 is guided downward by the guide 423, which has the following advantage.

The intermediate transfer belt 129 is positioned above the developing device 113 in the direction of gravity. By contrast, the downward flow fd discharged from the exhaust vents m1 is guided down the developing device 113 and is not directed to the lower face of the intermediate transfer belt 129 (shown in FIGS. 1 and 4).

Specifically, as shown in FIG. 4, the process cartridges 106 are arranged linearly in the belt travel direction of the intermediate transfer belt 129, to which respective color toners are sequentially transferred from the process cartridges 106. At that time, the toner image transferred from the upstream process cartridge 106 passes above the developing device 113 of the downstream process cartridge 106 before another color toner image is transferred thereon. In the present embodiment, the air discharged from the exhaust vents m1 of the downstream developing device 113 is guided down and turns into the downward flow fd. Therefore, even if the airflow is discharged from the exhaust vents m1 into an interior of the apparatus, the airflow is not directed to the toner image transferred from the upstream process cartridge 106. Thus, the guide 423 of the development casing 41 of the developing device 113 can serve as a downward duct. Accordingly, incorporating the developing device 113 according to the present embodiment into a tandem image forming apparatus is advantageous in that the airflow is prevented from blowing off the toner image primarily transferred on the intermediate transfer belt 129 and image density reduction can be inhibited.

According to the embodiment described above, the opening area of the vents m1 is greater in the longitudinal end portions than in the longitudinal center portion. Accordingly, even when pressure in the end portion rises due the airflow, which tends to surge to rather the end portions than the center portion, the airflow can be easily discharged outside the device. Thus, the airflow exhaust capability can be enhanced, and pressure rise in the longitudinal end portions can be inhibited. Reduction in internal pressure is effective in inhibiting toner scattering and clogging with toner of the end portions of the filter 45. Thus, increases in the frequency of maintenance can be prevented.

Descriptions are given below of toner usable in the developing device 113 according to the present embodiment.

The toner used in the present embodiment has first and second shape factors SF-1 and SF-2 both within a range from 100 to 180, for example. This setting can increase the amount of external additive adhering to a single toner particle and the amount of inorganic particles that protect the surface of a base particle from external stress caused by collision with carrier particles.

Additionally, in the toner used in the present embodiment, the rate of toner fine particles of 2 μm or smaller is less than 30%. When the rate of such fine particles is greater than 30%, the number of inorganic particles adhering to a single toner particle decreases. Accordingly, the cohesive force among toner particles increases, thus degrading the fluidity of developer. This degrades dispersion of supplied toner in developer as well.

The shape factors SF-1 and SF-2 used here are obtained as follows.

The first shape factor SF-1 shows a degree of roundness of toner shape and is expressed by the following formula:

$$SF\text{-}1=\{(MXLNG)^2/AREA\}\times(100\Pi/4)$$

wherein MXLGN is a maximum length of toner particle projected on a two-dimensional surface and AREA is an area of the toner particle. The toner particle is a sphere when the first shape factor SF-1 is 100. As the SF-1 increases, the toner particle becomes more amorphous.

The second shape factor SF-2 shows a degree of irregularity and expressed by the following formula:

$$SF\text{-}2=\{(PERI)^2/AREA)\}\times(100/4\pi)$$

wherein PERI is a peripheral length of toner particle projected on a two-dimensional surface and AREA is the area of the toner particle.

The surface of the toner particle is smooth without surface unevenness when the second shape factor SF-2 is 100. As the second shape factor SF-2 increases, the surface unevenness increases.

The first shape factor SF-1 and second shape factor SF-2 can be measured based on a photograph taken by a scanning electron microscope, S-800 (Hitachi, Ltd). The photograph can be analyzed by an image analyzer, LUSEX3 manufactured by NIKON CORPORATION.

A second embodiment is described below.

FIG. 9 illustrates the developing device 113*a* according to the second embodiment.

In the above-described first embodiment, the number of the exhaust vents m1 is greater in the longitudinal end portions by than in the longitudinal center portion ap.

In the developing device 113*a* shown in FIG. 9, multiple exhaust vents m2c and m2s are formed in an exhaust-side wall 419*a* that forms an outer wall of a decompression portion 60*a* and arranged in the longitudinal direction of the developing device 113*a*. The exhaust vents m2c and m2s are designed such that the opening area of the exhaust vent m2s in either end portion by is greater than the opening area of the exhaust vent m2c in the longitudinal center portion ap. In the configuration shown in FIG. 9, for example, a length Lms of the exhaust vent m2s in the longitudinal end portion by is greater than a length Lmc of the exhaust vent m2c in the longitudinal center portion ap.

Although the exhaust vent m2c and the exhaust vent m2s are identical in height in the second embodiment, alternatively, the height of the exhaust vent m2s in the longitudinal end portion by may be greater than that of the exhaust vent m2c. Either case is applicable as long as the opening area in the longitudinal end portion by is greater than that in the longitudinal center portion ap to enhance the airflow exhaust capability of the longitudinal end portions.

In this configuration, the airflow AF inside the pressure-release compartment E is deflected to the both end sides as in the first embodiment, and the airflow AF can be discharged easily from the exhaust vent m2s that is greater in opening area. Accordingly, the airflow AF, which tends to surge to the end sides, can be easily discharged outside the device. Thus, the airflow exhaust capability can be enhanced, inhibiting pressure rise in the longitudinal end portions. Thus, the developing device 113*a* can attain effect similar to those attained by the developing device 113 of the first embodiment.

A third embodiment is described below.

In the first embodiment, airflow discharged from the exhaust vents m1 are guided down by the guide 423 integrally formed with the sealing lid 42. Alternatively, instead of providing the guide 423, a duct may be provided as shown in FIG. 11.

Figure 11:
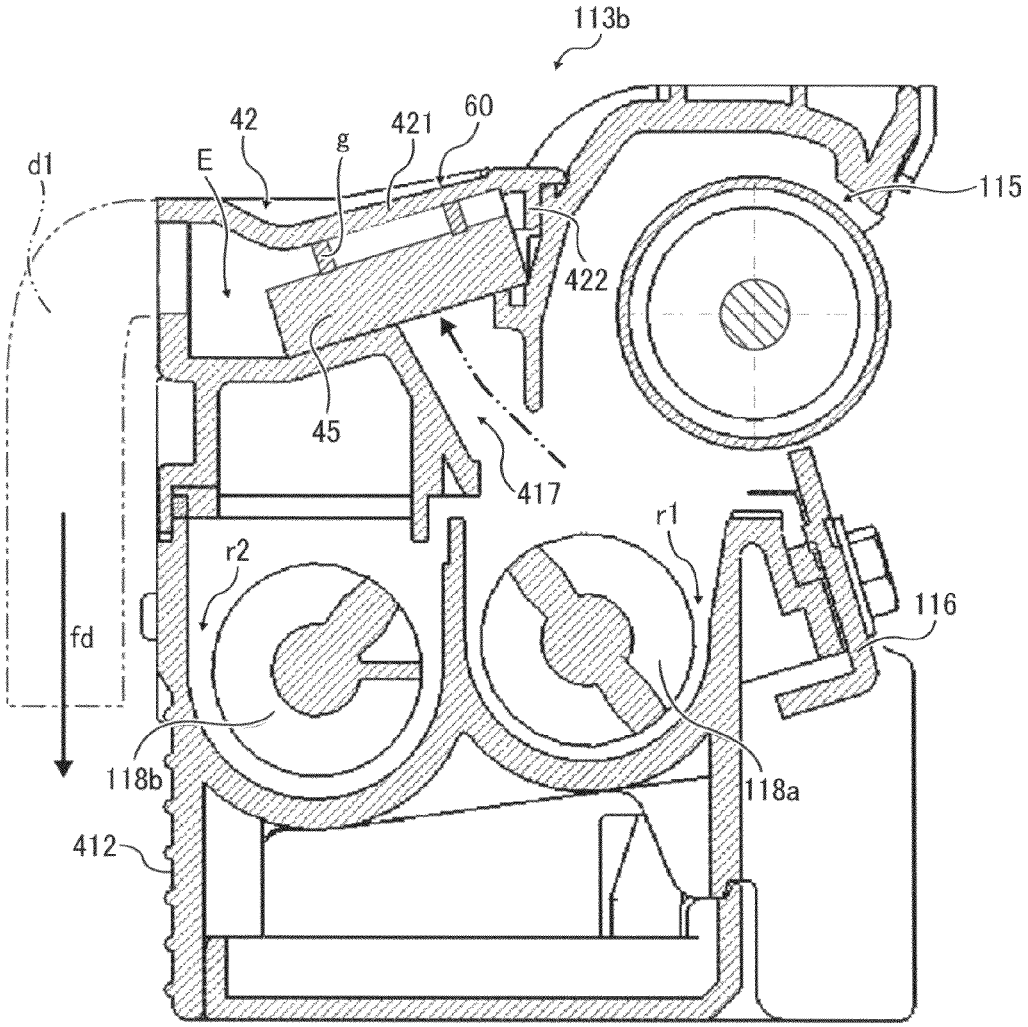
FIG. 11 is a schematic side view of a developing device according to yet another embodiment.

FIG. 11 illustrates a developing device 113*b* according to the third embodiment that includes a sealing lid 42*b* provided with a duct d1 to generate the downward flow fd instead of providing the guide 423.

In this configuration as well, the airflow is prevented from blowing off the toner image primarily transferred on the intermediate transfer belt 129 and image density reduction can be inhibited.

It is to be noted that the various aspects of the present specification can adapt to, not limited to multicolor copiers, other types of image forming apparatuses such as printers and fax machines.

Additionally, developer is not limited to two-component developer. Various aspects of the present specification can adapt to configurations in which pressure inside a developer containing chamber containing one-component developer increases due to agitation of developer and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device to develop with developer a latent image formed on an image bearer, the developing device comprising:

a developer bearer to carry developer, disposed facing the image bearer;

a developer conveyance member disposed facing the developer bearer, the developer conveyance member to agitate developer contained in the developing device and supply developer to the developer bearer;

a decompression portion surrounded by upper walls of the developing device, the decompression portion including multiple vents arranged in a longitudinal direction of the developing device; and a filter provided inside the decompression portion, wherein a number of the multiple vents is greater in an end portion than in a center portion, each of two end portions and the center portion being mutually exclusive and equal in length in the longitudinal direction of the developing device.

2. The developing device according to claim 1, wherein the multiple vents of the decompression portion open in a direction perpendicular to both of the longitudinal direction of the developing device and a vertical direction.

3. The developing device according to claim 1, wherein the multiple vents are formed in, among the upper walls of the developing device, a wall positioned on a side opposite the developer bearer.

4. The developing device according to claim 1, wherein the filter is disposed facing the developer conveyance member.

5. The developing device according to claim 1, further comprising a guide to guide airflow discharged from the multiple vents to flow downward.

6. The developing device according to claim 1, further comprising:

a lower case to hold the developer bearer and the developer conveyance member;

an upper case attached to the lower case and including the decompression portion; and a cover provided to the upper case to cover the filter.

7. The developing device according to claim 6, wherein the multiple vents are formed in a wall of the upper case, the wall positioned on a side opposite the developer bearer.

8. The developing device according to claim 6, further comprising a guide portion projecting from an outer rim of the wall of the upper case in which the multiple vents are formed, the guide portion extending downward to guide airflow discharged from the multiple vents to flow downward.

9. A developing device to develop with developer a latent image formed on an image bearer, the developing device comprising:

a developer bearer to carry developer, disposed facing the image bearer;

a developer conveyance member disposed facing the developer bearer, the developer conveyance member to agitate developer contained in the developing device and supply developer to the developer bearer;

a decompression portion surrounded by upper walls of the developing device, the decompression portion including multiple vents arranged in a longitudinal direction of the developing device; and a filter provided inside the decompression portion, wherein an opening area of the multiple vents is greater in an end portion than in a center portion, each of two end portions and the center portion being mutually exclusive and equal in length in the longitudinal direction of the developing device.

10. The developing device according to claim 1, further comprising:

an inlet to suck in air from inside the developing device into the decompression portion, wherein the multiple vents are to discharge air from the decompression portion outside the developing device, and the filter is between the inlet and the multiple vents.

11. The developing device according to claim 9, wherein the multiple vents of the decompression portion open in a direction perpendicular to both of the longitudinal direction of the developing device and a vertical direction.

12. The developing device according to claim 9, wherein the multiple vents are formed in, among the upper walls of the developing device, a wall positioned on a side opposite the developer bearer.

13. The developing device according to claim 9, wherein the filter is disposed facing the developer conveyance member.

14. The developing device according to claim 9, further comprising a guide to guide airflow discharged from the multiple vents to flow downward.

15. The developing device according to claim 9, further comprising:

a lower case to hold the developer bearer and the developer conveyance member;

an upper case attached to the lower case and including the decompression portion; and a cover provided to the upper case to cover the filter.

16. The developing device according to claim 15, wherein the multiple vents are formed in a wall of the upper case, the wall positioned on a side opposite the developer bearer.

17. The developing device according to claim 15, further comprising a guide portion projecting from an outer rim of the wall of the upper case in which the multiple vents are formed, the guide portion extending downward to guide airflow discharged from the multiple vents to flow downward.

18. The developing device according to claim 9, further comprising:

an inlet to suck in air from inside the developing device into the decompression portion, wherein the multiple vents are to discharge air from the decompression portion outside the developing device, and the filter is between the inlet and the multiple vents.

19. An image forming apparatus comprising:

an image bearer on which a latent image formed; and a developing device to develop the latent image with developer, the developing device including a developer bearer to carry developer, disposed facing the image bearer, a developer conveyance member disposed facing the developer bearer, the developer conveyance member to agitate developer contained in the developing device and supply developer to the developer bearer, a decompression portion surrounded by upper walls of the developing device, the decompression portion including multiple vents arranged in a longitudinal direction of the developing device, and a filter provided inside the decompression portion, wherein the multiple vents open in a direction perpendicular to both of the longitudinal direction of the developing device and a vertical direction, and a number of the multiple vents is greater in an end portion than in a center portion, each of two end portions and the center portion being mutually exclusive and equal in length in the longitudinal direction of the developing device.

20. The image forming apparatus according to claim 19, further comprising:

an inlet to suck in air from inside the developing device into the decompression portion, wherein the multiple vents are to discharge air from the decompression portion outside the developing device, and the filter is between the inlet and the multiple vents.

* * * * *